US006347414B2

(12) United States Patent
Contadini et al.

(10) Patent No.: US 6,347,414 B2
(45) Date of Patent: Feb. 19, 2002

(54) INTELLIGENT DEMAND-BASED DISPENSING SYSTEM

(75) Inventors: Carl D. Contadini, Terryville; John J. Dean, Oxford, both of CT (US)

(73) Assignee: Waterbury Companies, Inc., Waterbury, CT (US)

( * ) Notice: Subject to any disclaimer, the term of this patent is extended or adjusted under 35 U.S.C. 154(b) by 0 days.

(21) Appl. No.: 09/775,405

(22) Filed: Feb. 1, 2001

Related U.S. Application Data

(60) Provisional application No. 60/180,332, filed on Feb. 4, 2000.

(51) Int. Cl.[7] ..... E03D 9/00
(52) U.S. Cl. ..... 4/222
(58) Field of Search ..... 4/222, 223, 228.1, 4/DIG. 3

(56) References Cited

U.S. PATENT DOCUMENTS

| | | | | |
|---|---|---|---|---|
| 2,409,535 | A | 10/1946 | Bracke | 4/222 |
| 5,377,363 | A | 1/1995 | Shieh | 4/222 X |
| 5,772,074 | A | 6/1998 | Dial et al. | 222/1 |
| 6,009,567 | A | 1/2000 | Dean et al. | 4/226.1 |

*Primary Examiner*—Robert M. Fetsuga
(74) *Attorney, Agent, or Firm*—Carmody & Torrance LLP

(57) ABSTRACT

A dispensing system for use in an area of interest, the system comprising at least one device for sanitize conditioning a medium, a sentry for detecting an object and for communicating with the at least one device, the sentry itself comprising a detector for detecting the object and a controller, operatively coupled to the detector, for maintaining a count of the number of objects detected by the detector, wherein the controller transmits one or more variables, based on the count, to the at least one device to cause the at least one device to sanitize condition the medium in accordance with the one or more variables.

22 Claims, 3 Drawing Sheets

30

| DEMAND | PARAMETERS/VARIABLES | |
|---|---|---|
| # PERSONS | CYCLE FREQUENCY | INTENSITY OF ACTIVATION |
| < 5 | 15 MINUTES | LOW |
| 5–25 | 10 MINUTES | LOW |
| 25–100 | 5 MINUTES | MEDIUM |
| 100–200 | 45 SECONDS | HIGH |
| | | |

32

INTELLIGENT DEMAND-BASED DISPENSING SYSTEM

RELATED TO U.S. APPLICATION DATA

This application claims the benefit of U.S. Provisional Application No. 60/180,332 filed on Feb. 4, 2000.

BACKGROUND OF THE INVENTION

This invention relates generally to dispensing systems and, in particular, to a dispensing system for freshening, deodorizing, sanitizing and disinfecting an area of interest such as, for example, urinals, commodes and the atmosphere in rest rooms.

It is known to provide dispensing systems for freshening, deodorizing, sanitizing and disinfecting the air and/or the water within, for example, rest rooms to overcome undesirable odors in the atmosphere and bacteria in urinals and commodes. Generally speaking, these dispensing systems are stand-alone, event-driven devices. For example, one type of atmospheric dispensing system includes a timer that controls the release into the atmosphere of an olfactory simulating material at periodic intervals. That is, either continually or during preset hours of operation, a timer triggers the release into the atmosphere of the olfactory simulating material at periodic intervals of, for example, about 15 minutes. One such atmospheric dispensing system including this type of a time-based event controller is described in commonly assigned, U.S. Pat. No. 5,772,074.

Another type of stand-alone, event-driven dispensing system for urinals and commodes releases a sanitary conditioning solution upon the activation of a flush valve. That is, as the flush valve of a urinal or commode is activated water passes through an inline sanitary conditioning system to the inlet of a bowl of the urinal or commode. The released water and the dispensing system cooperate to deliver water to the bowl that includes the sanitary conditioning solution. One example of this type of stand-alone, use-based event controlled sanitary device is described in commonly assigned, U.S. Pat. No. 6,009,567. The disclosure of U.S. Pat. Nos. 5,772,074 and 6,009,567 are incorporated by reference as if fully set forth herein.

The inventors of the present invention have realized that a perceived disadvantage in the event-driven control devices of conventional dispensing systems lies in their inability to monitor and respond to the load or demand placed on each device and the demand on the rest room or other room environments as a whole. It follows, therefore, that the conventional dispensing systems can not adequately respond to the situation in which the more persons utilizing a facility, the greater the bacteria deposited therein and the greater the potential odors arising therefrom.

Accordingly, the inventors have realized that there is a need for an interactive, demand-based dispensing system that coordinates the response of stand-alone dispensing devices within an area of interest to the number of persons utilizing the area to, in effect, substantially overcome the undesirable odors in the atmosphere and bacteria in urinals and commodes.

SUMMARY AND OBJECTIVES OF THE INVENTION

Therefore, it is a first object and advantage of the present invention to provide an interactive, demand-based dispensing system for sanitize conditioning an area of interest.

It is a further object and advantage of the present invention to provide a dispensing system that controls at least one stand-alone dispensing devices within an area of interest in response to the number of persons utilizing the area.

It is a still a further object and advantage of the present invention to provide a dispensing system that controls at least one stand-alone dispensing devices within an area of interest in response to sensing other criterions, such as vapor, odor, smell or fragrance by utilizing an electronic nose, such as that described below.

Further objects and advantages of this invention will become more apparent from a consideration of the drawings and ensuing description.

To overcome the perceived deficiencies in the prior art and to achieve the objects and advantages listed above, the present invention is, generally speaking, directed to a dispensing system for use in an area of interest, such as for example, and not limitation, a restroom. In a preferred embodiment, the system comprises at least one device for sanitize conditioning a medium. It should be understood that the term "sanitize conditioning" should be construed in its broadest sense as a system or device that may freshen, deodorize, sanitizes, disinfect or otherwise condition the medium. Likewise, the term "medium" should be understood to include air or water (as applicable). A sentry is also provided for detecting an object and for communicating with the at least one device. For this reason, the sentry comprises a detector for detecting the object and a controller, operatively coupled to the detector, for maintaining a count of the number of objects detected by the detector, wherein the controller transmits one or more variables, based on the count, to the at least one device to cause the at least one device to sanitize condition the medium in accordance with the one or more variables.

In preferred embodiments, if the medium is the air, the device may be mounted to or on a wall or the like. Similarly, if the medium is water, the device may be mounted on or in connection with a urinal or toilet. The area of interest may be a restroom and, if so, the sentry may be positioned proximate the entrance of the restroom. In this way, the detector may detect the presence of persons that enter and/or exit the restroom and may communicate the presence of such persons to the controller. In this manner, the controller may maintain a count of the number of people that enter and/or exit the area of interest, evaluate the count representing the number of people that have entered and/or exited the area of interest, and based on the count, communicate one or more variables to the device. Specifically, the one or more variables transmitted by the controller to the device may include the frequency and/or intensity of the sanitize conditioning of the medium by the device.

In a further preferred embodiment, the device may include a transmitter and the controller may include a receiver for receiving transmissions from the device. In this way, the device can communicate with the controller to indicate that the device requires, for example, a replenishment of a sanitize conditioning material. The sentry may even include a display for indicating a sanitary conditioning condition of the area of interest or the status of operability of the device.

It is within the scope of the invention to have a system in which there is a plurality of devices for sanitize conditioning both the air and the water in a restroom or other area of interest. The system may also include a plurality of sentries and a central unit for operable communication with each of the plurality of sentries, the central unit for at least one of monitoring and coordinating the response of each sentry of the plurality of sentries.

In a further embodiment, the sentry may be configured for detecting a vapor, odor, smell or fragrance and processing the detected vapor, odor, smell or fragrance. In this way, the controller may be configured to transmit one or more variables, based on the processed result of the detection, to the device to cause the device to sanitize condition the medium in accordance with the one or more variables. By way of example, the detector in this embodiment may be what is known in the art as an electronic nose.

In another embodiment, the controller may transmit information, based on the count, to the device to cause the device to sanitize condition the medium in accordance with one or more variables. In this way, the storage of the variables may take place in the device(s) and not the sentry itself.

Lastly, in accordance with the present invention, a method of sanitize conditioning at least one medium in an area of interest with a dispensing system comprising at least one device for sanitize conditioning the medium and a sentry for detecting an object and for communicating with the at least one device, is provided. This methodology preferably comprises the steps of detecting an object and maintaining a count of the number of objects detected and transmitting one or more variables, based on the count, to the device to cause the device to sanitize condition the medium in accordance with the one or more variables. In a particularly preferred embodiment, the method comprises the steps of detecting the presence of persons entering and/or exiting the area of interest and storing the number of such persons within a memory of the sentry, evaluating the count representing the number of people entering and/or exiting the area of interest, and based on the count, communicating the one or more variables to the at least one device. Here also, the one or more variables transmitted by the controller to the device may include the frequency and/or intensity of the sanitize conditioning of the medium by the device. Likewise, contemplated in the claimed methodology is the use of an electronic nose, use of a plurality of devices and/or sentries, and use of devices for sanitize conditioning both the air and water in an area of interest.

BRIEF DESCRIPTION OF THE DRAWINGS

The above set forth and other features of the invention are made more apparent in the ensuing Description of the Preferred Embodiments when read in conjunction with the attached Drawings, wherein.

DESCRIPTION OF THE PREFERRED EMBODIMENTS

Figure 1:
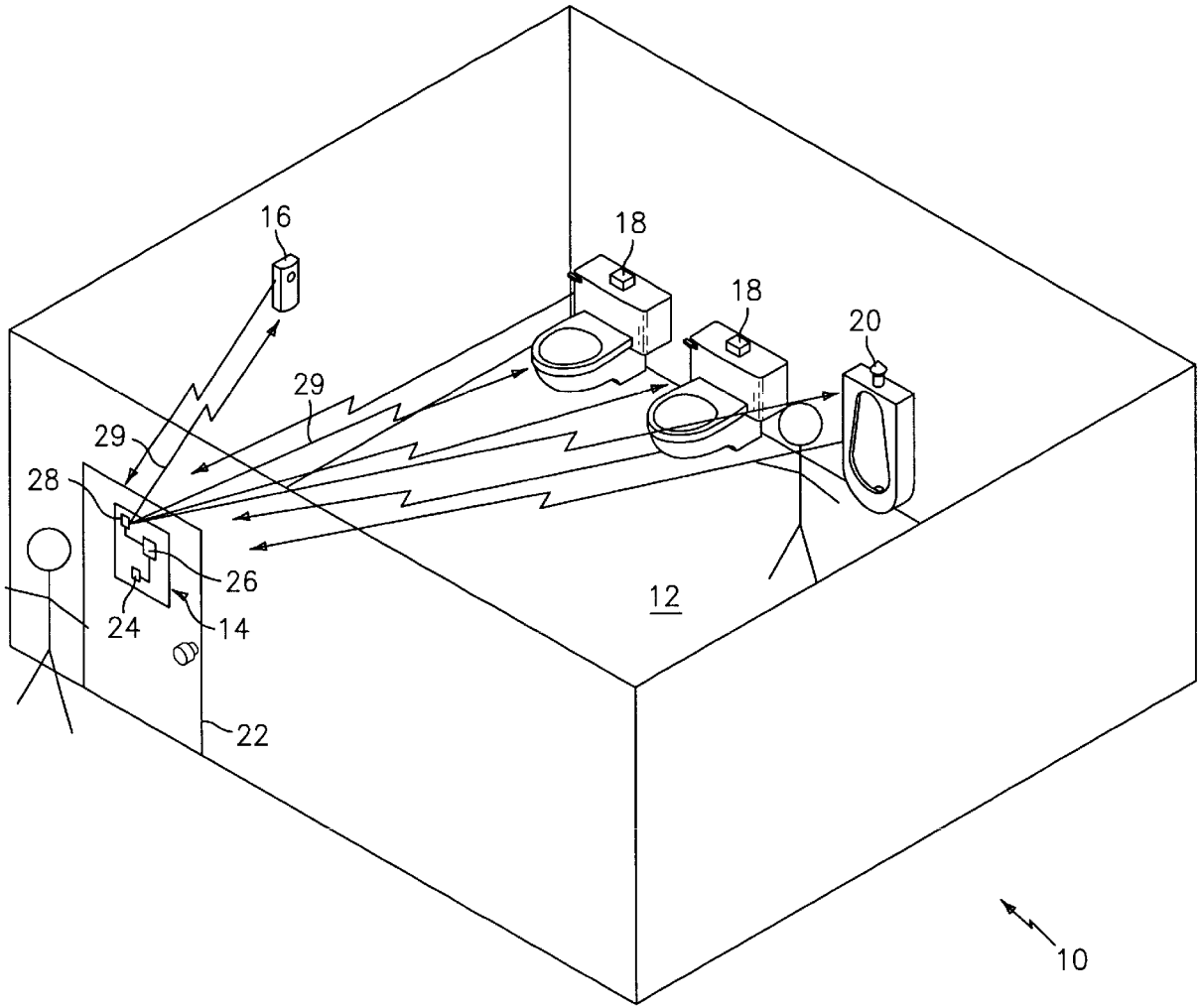
FIG. 1 is a simplified perspective view of an area of interest having an interactive, demand-based dispensing system, constructed in accordance with the present invention.

FIG. 1 illustrates a preferred embodiment of an interactive, demand-based dispensing system, generally indicated at 10, constructed in accordance with the present invention. Dispensing system 10 sanitize conditions the air and/or water within an area of interest such as, for example, a rest room 12. It should be understood that the term "sanitize conditioning" (or a form thereof) should be construed in its broadest sense as a system or device that may freshen, deodorize, sanitizes, disinfect or otherwise condition the air and/or water (as applicable) as would be understood in the art. The dispensing system 10 includes a sentry, generally indicated at 14, and at least one stand-alone air and/or water sanitize conditioning device (e.g., devices 16, 18 and 20). As can be seen in FIG. 1, the sanitize conditioning device may be mounted on a wall (device 16) for sanitize conditioning the air, or may be mounted on a toilet (device 18) for sanitize conditioning the water, or may be mounted on or in connection with a urinal (device 20) also for sanitize conditioning the water. Obviously, devices 18 and 20 may include features for sanitize conditioning the air as well.

Preferably, the sentry 14 is mounted within an entrance or doorway of the rest room 12. For example, in FIG. 1, the sentry 14 is mounted on a door 22 of the rest room 12. It should be appreciated that in other environments such as, for example, in a stadium or outdoor venue, the sentry 14 may be mounted on a wall or partition leading into an area wherein commodes or urinals are located.

Figure 2:
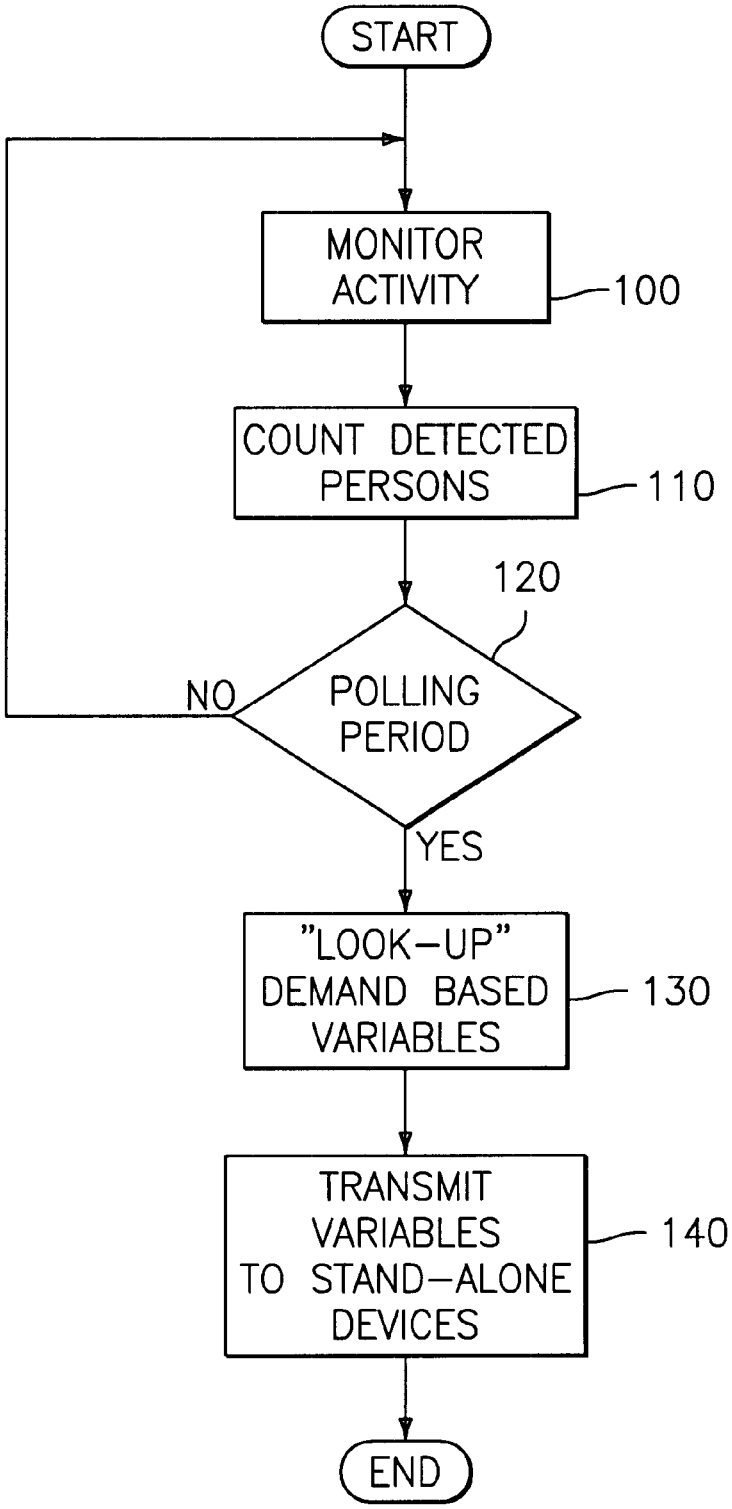
FIG. 2 illustrates a flow diagram of operating functions for a controller of a demand-based dispensing system operating and constructed in accordance with a preferred embodiment of the present invention.

Reference is now also made in conjunction with FIG. 2, to illustrate a simplified diagram of the operational logic of the sentry 14. At Step 100 the sentry 14 monitors the activity of the rest room 12 by, for example, counting the number of persons that enter the rest room 12. The sentry 14 includes a detector 24 and a controller 26. The detector 24 comprises, for example, an infrared detector, video recorder, pressure sensitive switch, RF detector, sonar detector or photodetector, that senses the presence of an object (e.g. a person or portion thereof) on or within a desired distance, such as a range of about a few inches to a few feet, of the detector 24. It should be appreciated that the desired distance of detection may vary from one installation to another and, therefore, it is within the scope of the present invention for the detector 24 to have a self compensating range detector and/or to permit an adjustment of the desired distance of detection.

As a person enters the rest room 12, the detector 24 detects their presence and generates a signal to the controller 26 to count the person. The controller 26, for example a microprocessor-based controller, includes an algorithm that performs the counting operation. As the program logic necessary to perform the counting operation is within the skill of those in the art, the details therein are not included herein. However, it should be appreciated that the algorithm should include a method of accommodating the fact that the detector 24 generally detects a person twice, i.e. entering and exiting the rest room 12 as well as those persons merely walking by and in close proximity to the sentry 14.

A value representing a "count" of those persons utilizing the rest room 12 is determined at Step 110 and is equal to the activity or demand of the rest room 12. In accordance with the present invention, the demand is periodically evaluated at Step 120, for example at a predetermined polling period which varies from seconds to hours, after which a control signal is transmitted from the sentry 14 to at least one of the stand-alone dispensing devices 16, 18 and/or 20. It should be appreciated that the polling period may be set according to the anticipated demand of the rest room 12, i.e. more or less frequently than stated above. For example, if the dispensing system 10 is employed in a relatively high traffic environment such as an airport, railway or bus terminal, the polling period may be set to a more frequent time period, such as for example, varying every second to hours. In this way, the dispensing system's 10 response to the demand of the rest room 12 is optimized.

Figures 3, 4:
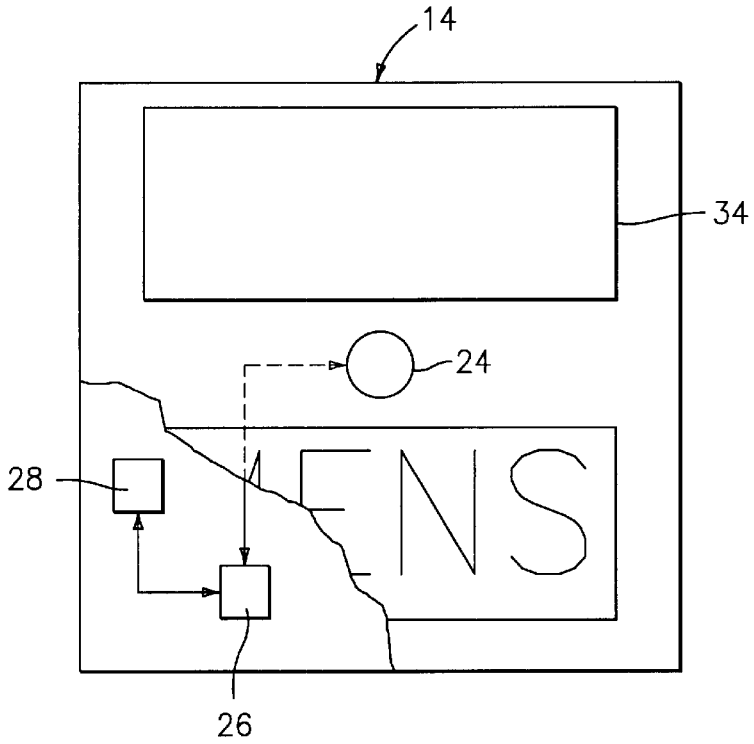
FIG. 3 is a simplified view of an exemplary look-up table that illustrates an exemplary configuration of user demand and corresponding operating variables for controlling stand-alone dispensing devices.
FIG. 4 is a simplified block diagram, in partial cross-section, of the preferred embodiment of a sentry controller of the interactive, demand-based dispensing system of FIG. 1.

The evaluation process may include a look-up operation (Step 130) in which a table, such as a table 30 illustrated in FIG. 3, is referenced to provide variables and/or parameters to direct the operation of the dispensing devices 16, 18 and/or 20. For example, and with reference to FIG. 3, if the demand within the most recent polling period is eight (8) persons, then a "Demand" column of table 30 is searched to identify a value corresponding to the calculated demand of 8 persons. In this example, row 32 of table 30 is identified. Accordingly, the controller 26 extracts a "Cycle Frequency" variable of "10 minutes" and a "Intensity of Activation" variable of "Low." Once the controller 26 retrieves the appropriate variables from the look-up table 30, the controller 26 transmits these variables to the cooperating dispensing devices 16, 18 and 20 at Step 140. Preferably, the sentry 14 includes a transmitter 28 such as, for example a radio frequency (RF) or infrared (IR) transmitter, for transmitting signals 29 that include the operating variables to the dispensing devices 16, 18 and 20. The dispensing devices 16, 18 and 20 include receivers (not shown) for receiving the transmitted signals 29. The dispensing devices 16, 18 and 20 are configured to be able to reset their operating variables to correspond to the most recently received values from the sentry 14. Still further, it is within the contemplated configuration that the controller 26 transmits, to one or more of the device, information based on which the device accesses its respective own look up table in its own memory, and sanitize conditions the air and/or water based thereon.

That is, the aforementioned look-up table need not be located in the controller but rather in the respective device (s). In this way, controller 26 need now only transmit to the appropriate device(s) the "Demand". With such "Demand" information, the device can adjust its variables for appropriate actuation. As such, the sentry 14 controls, in a demand-based manner, the dispensing devices 16, 18 and 20 and, in effect, the complete sanitize conditioning, such as by freshening, deodorizing, sanitizing, disinfecting and/or otherwise conditioning the air and/or water (as the case may be) within the rest room 12.

Although not included in the flow diagram of FIG. 2, it should be appreciated that the controller 26 may include a default process wherein each of the stand-alone dispensing devices 16, 18 and 20 are cycled (i.e. automatically activated) at a predetermined time of day or after a predetermined number of hours of non-use (i.e. after 12 hours of non-use).

In one embodiment, the sentry 14 and each of the dispensing devices 16, 18 and 20 may include transceivers such that signals may be transmitted and received between the sentry 14 and the respective devices 16, 18 and/or 20. Such a communication protocol would be well understood in the art and therefore, details thereof shall be omitted for brevity. However, the two-way lines of communication in FIG. 1 are deemed to represent communication via a two-way system with one or more of the devices 16, 18 or 20 and the sentry 14 including transceivers. In this way, the stand-alone dispensing devices 16, 18 and 20 may notify the sentry 14 of their status, e.g., that one of the stand-alone devices 16, 18 and 20 requires service as the sanitize conditioning material within the device has been completely dispensed.

FIG. 4 illustrates one embodiment of the sentry 14. As shown in FIG. 4, the sentry 14 may include the detector 24, the controller 26, the transmitter 28 and a display 34. The display 34, which may be, for example, a liquid crystal display, receives signals from the controller 26 to exhibit numbers, letters and/or symbols of interest. For example, the display 34 may exhibit informational or advertising messages to persons using the rest room or passing in proximity thereto. The informational messages may include a notice of the sanitary condition of the rest room 12 or of any one or more of the dispensing devices communicating to the sentry 14.

Preferably, the controller 26 may maintain statistics such as, for example, the number of persons counted using or passing by the rest room. The count may be retrieved to provide potential advertisers an indication of the "traffic" (i.e. persons per hour, per day or any other period of interest) passing by the display 34. For example, it may be of interest to identify traffic patterns within the maintained statistics such that a time period in which a maximum number of persons passing by the sentry 14 may be identified. It follows that it may be more desirable to advertise during the determined time period of maximum traffic.

In another aspect of the present invention, the maintained statistics of usage are stored as, for example, a history of demand within the environment of interest. Such a history may be utilized by the controller 26 and/or persons monitoring the dispensing system 10 to anticipate future demand on the stand-alone devices, e.g. devices 16, 18 and 20. For example, maintenance personnel monitoring the system 10 can ensure an adequate supply of sanitize conditioning material (such as that which may freshen, deodorize, sanitize, disinfect and/or otherwise condition the water and/or air) is present within each device 16, 18 and/or 20 to meet the anticipated needs of the system 10 over a predetermined period of time, for example, the next 12 or 24 hours, or longer.

In yet another aspect of the present invention, a number of systems, such as system 10, may be located throughout, for example, a building or other structure. It is within the scope of the present invention for each of the system 10 to communicate with a central location that monitors and/or coordinates the response of each system 10. As such, the demand on each system 10 may be monitored as well as the status of one or more stand-alone device within the building so that, for example, maintenance personnel may be dispatched from the central location if a undesirable status is received from one of the systems 10 or a stand-alone device located therein.

It should be appreciated that when multiple systems such as system 10 are located within a structure and, in particular, when more than one systems 10 are located in proximity to each other, there may be interference between the transmitted signals, i.e. signals 29, of each system 10. Therefore, it is also within the scope of the present invention for the transmitter 28 of each system 10 to transmit signals 29 within a predetermined range of frequencies. Similarly, each receiver of each of the devices 16, 18 and/or 20 is capable of receiving the transmitted signals within the predetermined range of frequencies. Accordingly, transmitted signals within systems 10 located in proximity can be adjusted such that interference between the systems 10 is substantially eliminated.

It is also envisioned and contemplated by the present invention that a plurality of devices may communicate with each other. For this reason, it is also contemplated that each device may be configured for communication with each other in the event, for example, that a particular device is out of range of the sentry 14, but yet that particular device needs to communicate with the sentry 14. For example, in a large area of interest it is envisioned that the sentry 14 may not be able to transmit a signal strong enough to communicate with a particular device because the device is located too far away from the sentry or in a position not easily communicatable with the sentry. This can be based on a plurality of reasons, some of which are battery power constraints and/or physical impediments, such as walls, partitions etc. In these situations, it is easier to have a relay configuration, wherein the devices relay information between one another until the desired device is reached. Such a network configuration is well known in the art and can improve battery life in the sentry and/or devices, thus illustrating one advantage thereof.

Although described in the context of preferred embodiments, it should be realized that a number of modifications to these teachings may occur to one skilled in the art.

For example, in addition to or in place of detector 28 as disclosed above, sentry 14 may include what is known in the art as an "Electronic Nose," which generally speaking, includes an array of sensors for recognizing and quantifying the concentrations of specific vapor mixtures (i.e. fragrances) containing many different chemical species. For example, instead of or in addition to the detector disclosed above, the Electronic Nose may provide an additional criterion for which communication to the devices to sanitize condition the air is necessary. That is, such an Electronic Nose may assist in providing additional information to the controller 26, based on the scent or odor (for example) in the area of interest, to cause the controller 26 to communicate properly to the devices 16, 18 and/or 20. Accordingly, for purposes of an enabling embodiment, it should be understood that detector 28 should be understood to be, in a preferred embodiment, an Electronic Nose and the controller should be configured accordingly to process such information. Although such a construction would be understood in the art, reference is made to the publication "Electronic Nose Simulation of Olfactory Response Containing 500 Orthogonal Sensors in 10 Seconds," by Edward J. Staples, the disclosure of which is incorporated by reference as if fully set forth herein.

Also, by example, and as discussed above, the teachings of this invention are not intended to be limited to the control of any specific type or number of stand-alone dispensing device. That is, control of any number of air and/or water purifying devices is contemplated.

While the invention has been particularly shown and described with respect to preferred embodiments thereof, it will be understood by those skilled in the art that changes in form and details may be made therein without departing from the scope and spirit of the invention.

What is claimed is:

1. A dispensing system for use in an area of interest, the system comprising:

at least one device for sanitize conditioning a medium;

a sentry for detecting an object and for communicating with the at least one device, the sentry comprising:

a detector for detecting the object;

a controller, operatively coupled to the detector, for maintaining a count of the number of objects detected by the detector;

wherein the controller transmits one or more variables, based on the count, to the at least one device to cause the at least one device to sanitize condition the medium in accordance with the one or more variables.

2. The dispensing system as claimed in claim 1, wherein the medium is air.

3. The dispensing system as claimed in claim 1, wherein the medium is water and the device is mounted on or in connection with a urinal or toilet.

4. The dispensing system as claimed in claim 1, wherein the area of interest is a restroom and the sentry is positioned proximate the entrance of the restroom.

5. The dispensing system as claimed in claim 1, wherein the detector detects the presence of persons that enter and/or exit the area of interest and communicates the presence of the persons to the controller.

6. The dispensing system as claimed in claim 5, wherein the controller maintains a count of the number of people that enter and/or exit the area of interest.

7. The dispensing system as claimed in claim 6, wherein the controller evaluates the count representing the number of people that have entered and/or exited the area of interest, and based on the count, communicates the one or more variables to the at least one device.

8. The dispensing system as claimed in claim 7, wherein the one or more variables transmitted by the controller to the at least one device includes the frequency and/or intensity of the sanitize conditioning of the medium by the at least one device.

9. The dispensing system as claimed in claim 1, wherein the at least one device includes a transmitter and the controller includes a receiver for receiving transmissions from the at least one device; and wherein the at least one device communicates with the controller to indicate that the at least one device requires a replenishment of a sanitize conditioning material.

10. The dispensing system as claimed in claim 1, wherein the sentry comprises a display for indicating a sanitary conditioning condition of the area of interest or the status of operability of the at least one device.

11. The dispensing system as claimed in claim 1, including a plurality of devices for sanitize conditioning a medium.

12. The dispensing system as claimed in claim 11, comprising:

a plurality of sentries;

a central unit for operable communication with each of the plurality of sentries, the central unit for at least one of monitoring and coordinating the response of each sentry of the plurality of sentries.

13. A dispensing system for use in an area of interest, the system comprising:

at least one device for sanitize conditioning a medium;

a sentry for detecting at least one of a vapor, odor, smell or fragrance and for communicating with the at least one device, the sentry comprising:

a detector for detecting the vapor, odor, smell or fragrance;

a controller, operatively coupled to the detector, for processing the detected vapor, odor, smell or fragrance;

wherein the controller transmits one or more variables, based on the processing, to the at least one device to cause the at least one device to sanitize condition the medium in accordance with the one or more variables.

14. The dispensing system as claimed in claim 13, wherein the detector is an electronic nose.

15. A dispensing system for use in an area of interest, the system comprising:

at least one device for sanitize conditioning a medium;

a sentry for detecting an object and for communicating with the at least one device, the sentry comprising:

a detector for detecting the object;

a controller, operatively coupled to the detector, for maintaining a count of the number of objects detected by the detector;

wherein the controller transmits information, based on the count, to the at least one device to cause the at least one device to sanitize condition the medium in accordance with one or more variables.

16. The dispensing system as claimed in claim 15, wherein:

the detector detects the presence of persons that enter and/or exit the area of interest and communicates the presence of the persons to the controller;

the controller maintains a count of the number of people that enter and/or exit the area of interest, evaluates the count and based on the count, communicates the information to the at least one device.

17. The dispensing system as claimed in claim 16, wherein the one or more variables include the frequency and/or intensity of the sanitize conditioning of the medium by the at least one device.

18. The dispensing device as claimed in claim 17, wherein the at least one device includes memory for storing the one or more variables and the information transmitted by the controller determines the one or more variables selected by the at least one device.

19. A method of sanitize conditioning at least one medium in an area of interest with a dispensing system comprising at least one device for sanitize conditioning the medium and a sentry for detecting an object and for communicating with the at least one device, the method comprising the steps of:

detecting an object and maintaining a count of the number of objects detected;

transmitting one or more variables, based on the count, to the at least one device to cause the at least one device to sanitize condition the medium in accordance with the one or more variables.

20. The method as claimed in claim 19, including the step of detecting the presence of persons entering and/or exiting the area of interest and storing the number of such persons within a memory of the sentry.

21. The method as claimed in claim 20, including the step of evaluating the count representing the number of people entering and/or exiting the area of interest, and based on the count, communicating the one or more variables to the at least one device.

22. The dispensing system as claimed in claim 21, wherein the one or more variables transmitted by the controller to the at least one device include the frequency and/or intensity of the sanitize conditioning of the medium by the at least one device.

* * * * *